US005617373A

United States Patent [19]

Kawai et al.

[11] Patent Number: 5,617,373

[45] Date of Patent: Apr. 1, 1997

[54] TIME TOTALING METER AND UNIT OF THE SAME FOR INTERNAL COMBUSTION ENGINE

[75] Inventors: Norio Kawai; Shigeo Take, both of Yokosuka, Japan

[73] Assignee: Oppama Industry Co., Ltd., Kanagawa-ken, Japan

[21] Appl. No.: 543,218

[22] Filed: Oct. 13, 1995

[51] Int. Cl.[6] ..... G04F 8/00; G04F 10/00

[52] U.S. Cl. ..... 368/5; 368/8; 368/9

[58] Field of Search ..... 368/3, 5, 6, 8, 368/9, 10, 110–113; 324/126, 133, 384, 402, 390–392; 377/20

[56] References Cited

U.S. PATENT DOCUMENTS

| | | | |
|---|---|---|---|
| 3,854,281 | 12/1974 | Reichect | 368/9 |
| 3,948,039 | 4/1976 | Leveraus | 368/5 |
| 3,965,669 | 6/1976 | Larson et al. | 368/5 |
| 4,181,883 | 1/1980 | Beeghly et al. | 324/166 |
| 4,725,996 | 2/1988 | Marble et al. | 368/9 |
| 4,999,820 | 3/1991 | Hetzel | 368/9 |
| 5,416,814 | 5/1995 | Gibbs et al. | 377/20 |

*Primary Examiner*—Vit W. Miska

*Attorney, Agent, or Firm*—Michael D. Bednarek; Kilpatrick & Cody, L.L.P.

[57] ABSTRACT

A time totaling meter and an unit thereof for internal combustion engines comprising a part of an ignition device to lead ignition pulses toward outside of the ignition device, pulse induction means to electromagnetically induce said ignition pulses, waveform shaping means to shape this electro-magnetically induced pulses, and judging means to determine whether this waveform shaped output pulses are derived from operation of the internal combustion engine or not, and capable of counting and storing total operation time of the internal combustion engine from initial operation thereof to said count memory means based on said output pulses selected by said judging means and displaying this counted operation time on display means.

9 Claims, 10 Drawing Sheets

TIME TOTALING METER AND UNIT OF THE SAME FOR INTERNAL COMBUSTION ENGINE

BACKGROUND OF THE INVENTION

1. Field of the Invention

This invention relates to a time totaling meter and an unit of the same which can be used for maintenance and repair of working machines driven by an internal combustion engine such as chain saws, weed cutters and the like.

2. Description of Prior Art

Heretofore, none of working machines such as chain saws and weed cutters driven by an internal combustion engine has been installed with a time totaling meter or equivalent which is being used for maintenance and repair of a four-wheeled vehicle, a motor bicycle and the like. Therefore, for said working machines or internal combustion engines, a cumulative operated time can not be determined.

Maintenance and repair of said working machines and internal combustion engines are being made at an interval and frequency decided by its user or not being made at all. Consequently, there were several problems, due to inadequate maintenance and repair of said working machines and internal combustion engines; it can not be used by unexpected trouble or broken parts causes accident involving human life, for example.

On the other hand, an attachable/detachable type of time totaling meter, which will be used in attached to a working machine itself, was proposed in order to avoid inadequate or incomplete maintenance and repair as mentioned above. According to this proposal, total time from initiation of operation of working machines and internal combustion engines can be counted and stored in a memory and further can be displayed.

Such attachable/detachable type of time totaling meter may be intentionally or unintentionally removed from said working machines by their users. Therefore, in case such time totaling meter was detached and again attached to the working machine, total operation time of the working machine without the time totaling meter is not added to the actual cumulative operation time of the working machine, and therefore counted, stored and displayed cumulative operation time does not reflect the actual cumulative operation time of said working machines and internal combustion engine from their initial operation. This is a problem for the attachable/detachable type of time totaling meter.

SUMMARY OF INVENTION

The present invention was made aiming at solving such problems of the prior art, and therefore the object of the present invention is to provide a time totaling meter for internal combustion engines capable of accurately counting, storing and displaying only total time during which an internal combustion engine of a working machine has been operated, allowing to do appropriately maintenance and repair of said working machine and internal combustion engine based on data of said cumulative operation time, and capable of being constructed simply and at low cost.

Another object of the present invention is to provide a time totaling meter for internal combustion engines capable of counting independently total operation time of a internal combustion engine from arbitrarily selected time point in addition to total operation time from the start of initial operation and displaying these by choice.

Further object of the present invention is to provide a time totaling meter for internal combustion engines capable of allowing to make a whole shape compactly and to reduce manufacturing cost by installing a pulse control circuit together with a part of an ignition device onto the same printed wiring board.

Another object of the present invention is to provide a time totaling meter for internal combustion engines capable of implementing quickly and accurately an electrical connection to an ignition circuit of an ignition device.

Further object of the present invention is to provide a time totaling unit for internal combustion engines capable of realizing a compact construction and simple operation by forming the time totaling meter and a part of an ignition device in one body.

Another object of the present invention is to provide a time totaling unit for internal combustion engines capable of realizing a compact construction, simple assembling and simple operation by forming a time totaling meter and a part of an ignition device together with re-setting means of counted/stored values in one body.

Further object of the present invention is to provide a time totaling meter for internal combustion engines capable of implementing highly sensitive measurement of total operation time.

Additional object of the present invention is to provide a time totaling meter for internal combustion engines capable of realizing the connection of cables from an unit block to the time totaling meter in a small occupation space and also capable of realizing to place it in a small package because it is not necessary to form any convex on the surface.

Further object of the present invention is to provide a time totaling meter capable of displaying total operation time of an internal combustion engine based on its revolution number by picking up electromagnetic wave from a high tension cable into an induction coil via an antenna lead and also capable of realizing treatment of said antenna lead in a small occupation space.

In order to achieve said objects, the present invention comprises a part of an ignition device to lead ignition pulses toward the outside of the ignition device, pulse induction means to electromagnetically induce ignition pulses flowing in a part of said ignition device, waveform shapeing means to shape pulse waveform electromagnetically induced by said pulse induction means, and judging means to distinguish output pulses of said waveform shapeing means generated by the internal combustion engine from other sources, wherein total operation time of said internal combustion engine from its initial operation is counted and stored in count memory means based on said output pulses distinguished by said judging means and thus counted operation time by said count memory means is displayed on display means.

In the time totaling meter according to the present invention, by electrical connection of a part of the ignition device in the working machine via a connector, the pulse induction means can detect ignition pulses flowing in a part thereof and judge whether this pulse wave shaped output was obtained by unit time or not, the count memory means can accurately count and store the cumulative time from the initial operation of the internal combustion engine and this value is displayed.

Further, in the present invention, judging means provided can distinguish only pulses derived from the driving internal combustion engine from all wave shaped output pulses electrically induced by the pulse induction means. Based on this output pulses, the first count memory means can count and store total operation time of the internal combustion engine from its initial operation, the second count memory means, when user manipulated re-set means at an arbitrary time point, start to count and store total operation time of the internal combustion engine. And said first and second count memory means display the stored operation time.

Therefore, in this time totaling meter for internal combustion engines, total operation time from the initial operation is accurately counted, stored and displayed by the first count memory means, and when user manipulated the re-set means, the second count memory means accurately count, store and display total operation time from the time point arbitrarily set by the user.

Furthermore, in the present invention, a part of the ignition device is mounted on the printed wiring board on where pulse induction means and the pulse control circuit to treat pulses induced by said pulse control means have already provided. Therefore, in this time totaling meter for internal combustion engines, two printed wiring boards are not always necessary so that the main body of time totaling meter can be made in compact and at low cost.

In addition, in the present invention, a part of the ignition device is connected to a half-way of a circuit introducing induced voltage to a charge/discharge ignition capacitor in the ignition circuit of the ignition device via an attachable/detachable connector.

Therefore, in this time totaling meter for internal combustion meter, electrical and mechanical connection of the main body of the time totaling meter to the ignition circuit of the working machine can be accurately and simply by one touch. Further, according to the present invention, the time totaling meter comprising pulse induction means, waveform shaping means, judging means, count memory means and display means is formed in one body with the ignition device for the internal combustion engine by the injection mold or the embedded mold using synthesized resin.

Therefore, in this time totaling unit for internal combustion engines, these parts formed in one body can be handled as a unit block so that a whole ignition control system for internal combustion engines can be made in compact and reliability thereof can be improved.

Furthermore, according to the present invention, the time totaling meter is provided with first and the second count memory means to count and store number of output signals from the waveform shaping means, re-setting means to re-set counts or stored memory in said second count memory means by manipulation of operator, and display means to display the time corresponding to counts or stored memory counted and stored by said first and second count memory means, wherein said time totaling meter and said ignition device of the internal combustion engine are formed in one body by the injection mold or the embedded mold of synthesized resin.

Therefore, this time totaling unit for internal combustion engines can realize an ignition control system having an ignition control halt function by one unit block as well as miniaturizing of said ignition control system as a whole and improvement of reliability of operation thereof.

In addition, the present invention is constructed so as to connect between the ignition device and said time totaling meter via cables, thereby being able to implement time totaling treatment based on ignition pulses obtained via said cables.

Therefore, this time totaling unit for internal combustion engines can directly pick up ignition pulses from the ignition device into a pulse detection part of the time totaling meter via the cables, thereby able to implement measurement of total time accurately and at high sensitivity based on adequate level of pulse data.

Further, in the present invention, the upper surface level at one corner of the time totaling meter is lowered so as to have pre-determined thickness and the cables are connected to a part of the ignition device provided on this position.

Therefore, in this time totaling meter for internal combustion engines, the end of the cables to be connected to the unit block can be housed inside the time totaling meter having pre-determined thickness. Because the connected part of the end of the cables does not significantly extrude toward outside, the space occupied by this connecting part can be minimized, thereby package size for the time totaling meter can be compacted.

Furthermore, the present invention comprises a case to house the waveform shaping circuit, count memory means and display means together with the induction coil, wherein one corner of the case has different surface level from the upper and lower surface of other part of the case so as to have pre-determined thickness, and several holes are provided so as to pass through said thinner part from the upper surface to the lower surface and said antenna lead can be inserted into the holes by bending the end part thereof.

Therefore, in this time totaling meter for internal combustion engines, ignition pulses supplying to an ignition plug can be electromagnetically detected by the induction coil via the high tension cable and the antenna lead and, by counting detected output pulses after waveform shaping, total operation time of the internal combustion engine can be simply and accurately measured.

Further, the end of said antenna lead can be connected to a part of the ignition device inside of said thinner part formed on one corner of the case, thereby the space occupied by this connection part can be minimized and therefore the package size for the time totaling meter can be reduced.

DETAILED DESCRIPTION OF THE PREFERRED EMBODIMENT

Figure 1:
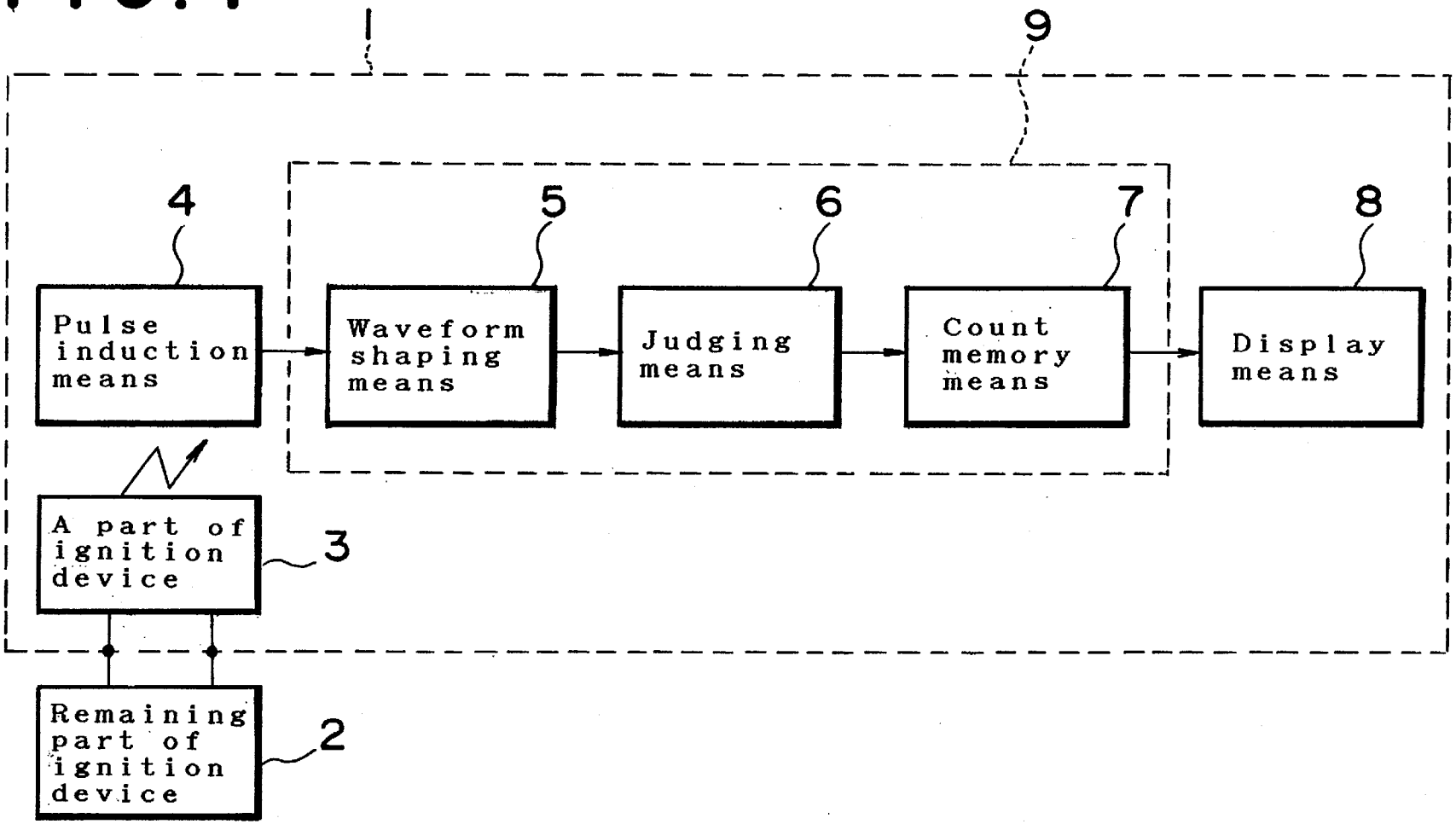
FIG. 1 is a block diagram showing a time totaling meter for internal combustion engines according to one embodiment of the present invention.

FIG. 1 is a block diagram showing a whole time totaling meter according to the present invention. Numeral 1 is a time totaling meter and 2 is a remaining part of an ignition device connected to this time totaling meter 1. This time totaling meter 1 includes a part of the ignition device 3 connected to the remaining part of the ignition device 2.

In the time totaling meter 1, numeral 4 is print patterned pulse induction means comprising an electromagnetic induction coil, for example, and located near to a part of the ignition device 3 so as to induce and detect ignition pulses flowing in this part of the ignition device 3. Numeral 5 is waveform shaping means to shape waveform of output pulses induced.

Further, numeral 6 is judging means to distinguish whether said waveform shaped output could be obtained or not; that is, whether the internal combustion engine is actually operated (working) or not. 7 is count memory means to count and store surely and accurately total operation time from the initial operation (from the first operation) of the internal combustion engine based on normal waveform shaped output selected by this judging means 6.

Numeral 8 is display means such as a liquid-crystal display to display counted results by said count memory means 7. 9 is a pulse treatment circuit comprised said waveform shaping means 5, judging means 6 and count memory means 7.

Figure 2:
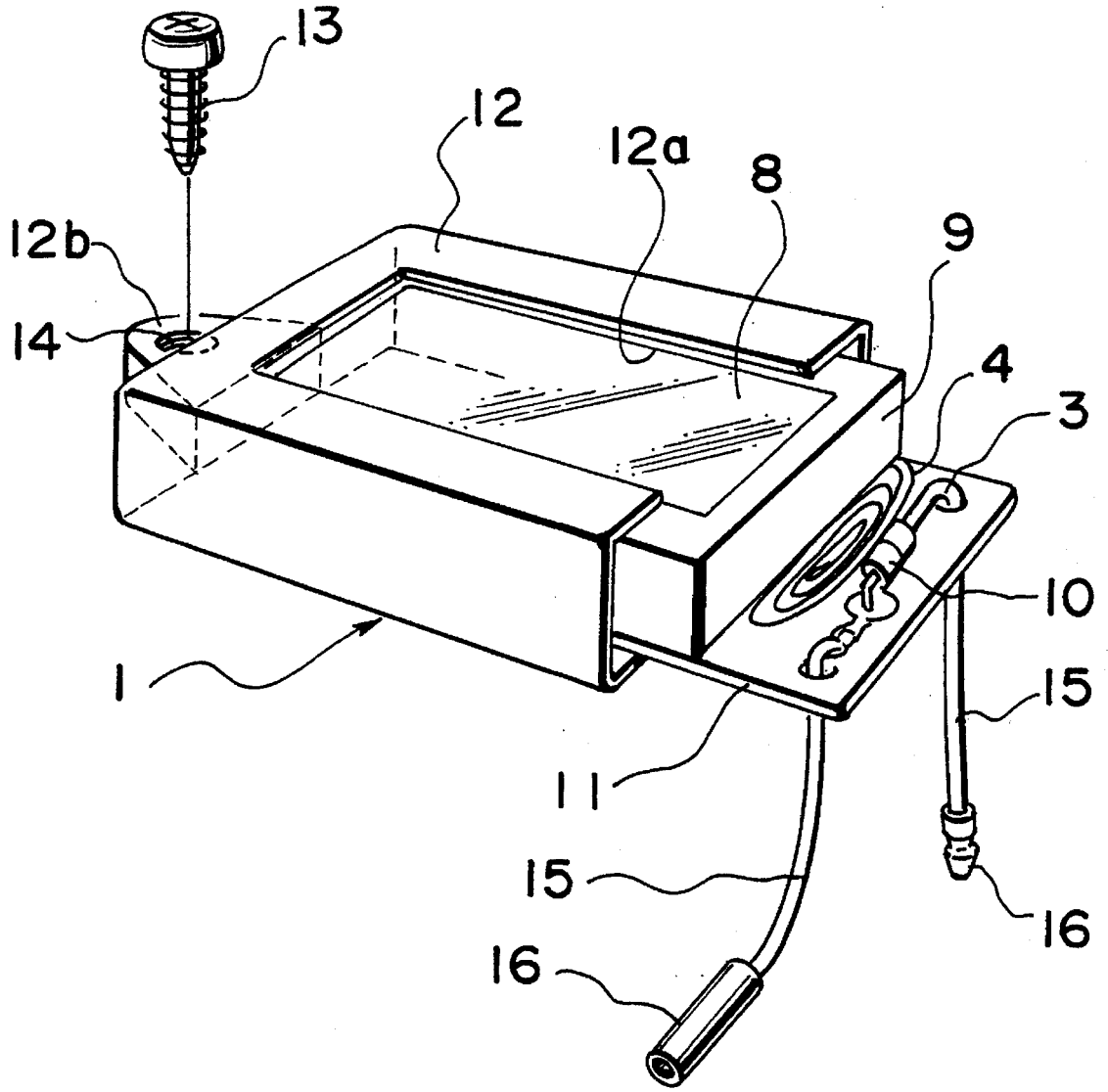
FIG. 2 is an outside view as well as partial inside view showing detail construction of a time totaling meter for internal combustion engines according to the present invention.

FIG. 2 is an outside view and partial inside view showing detail construction of said time totaling meter 1. In this drawing, a diode 10 consisting a part of the ignition device 3 is provided on the same printed wiring board 11 together with pulse induction means 4 and said pulse treatment circuit 9. However, a part of the ignition device 3 is not always necessary to include the diode 10.

As shown in FIG. 2, on the block of the pulse treatment circuit 9 provided with said display means 8. 12 is a case of the time totaling meter 1 to house a part of said ignition device 3, pulse induction means 4, pulse treatment circuit 9, printed wiring board 11 and the like. On an attachment piece **12*b* of this case 12 provided with a screw hole 14 to insert an attachment screw 13. 12*a* is a window for the display means 8**.

Numerals 15 and 15 are cables attached to both ends of the diode 10 consisting a part of said ignition device 3. 16 and 16 are two connectors attached to each cable 15 as connecting terminals. These connectors 16 are provided so as to be attachable or detachable to two connectors (detailed later) provided at the side of the remaining part 2 in the ignition device.

Figure 3:
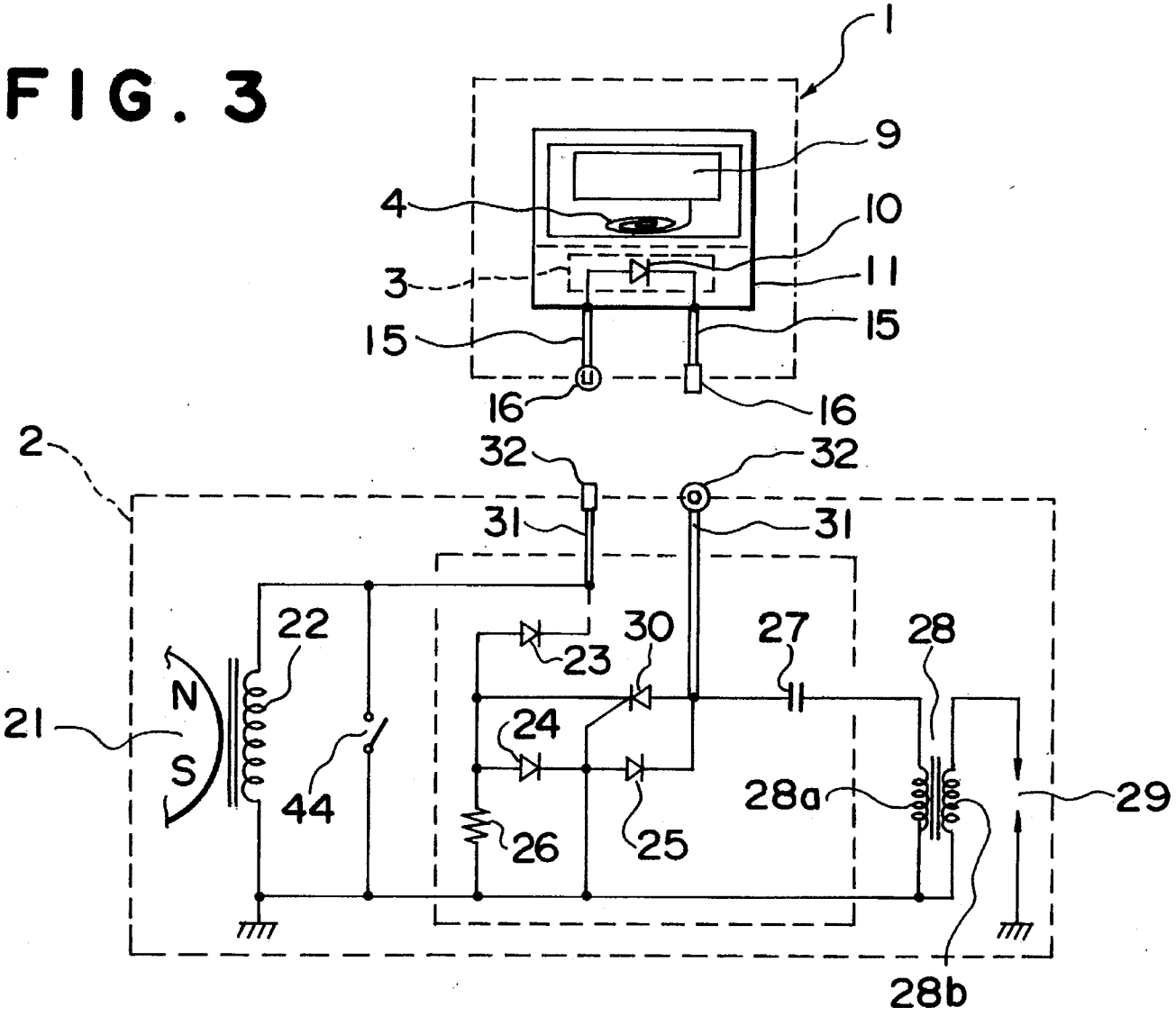
FIG. 3 is a circuit diagram showing the connection relationship between a time totaling meter and an ignition circuit for internal combustion engines according to the present invention.

FIG. 3 is a circuit showing detail of an ignition device for internal combustion engines according to the present invention. In this drawing, numeral 21 is a rotor having magnet or magnetic poles and rotating synchronously with rotation of the internal combustion engine. 22 is an induction coil to induce voltage according to approach and departure of said magnet by formation of the rotor 21.

Further, 23, 24 and 25 are rectifier diodes, and 26 is a resistor to set an electric potential to trigger a gate of a thyrister (detailed later).

27 is a charge/discharge capacitor for ignition and 28 is an ignition coil serially connected via the charge/discharge capacitor 27 and the diode 10 which is consisting of said part 3 of the ignition device. This ignition coil 28 is consisted of a primary coil **28*a* and a secondary coil 28*b* and an ignition plug 29 is connected to the secondary coil 28*b***.

Further, 30 is the thyrister which is serially connected to the charge/discharge capacitor 27 and then to the primary coil **28*a* of the ignition coil 28 via said resistor 26. The gate of the thyrister 30 is connected to the resistor 26 via the diode 24**.

Numerals 31 and 31 are a pair of cables provided so as to disconnect the circuit introducing induced voltage to the charge/discharge capacitor 27, and to the end of each cable is provided with a connector 32 as a connecting terminal. And, each of these connectors 32 is attachable to each connector 16 in said time totaling meter 1 by one touch.

In this case, because the diode 10 consisting of a part of the ignition device 3 is directional, each of the connectors 32 must be properly connected to each of the connectors 16.

Therefore, it is desirable to form one connector as male and another as female, for example.

Figure 4:
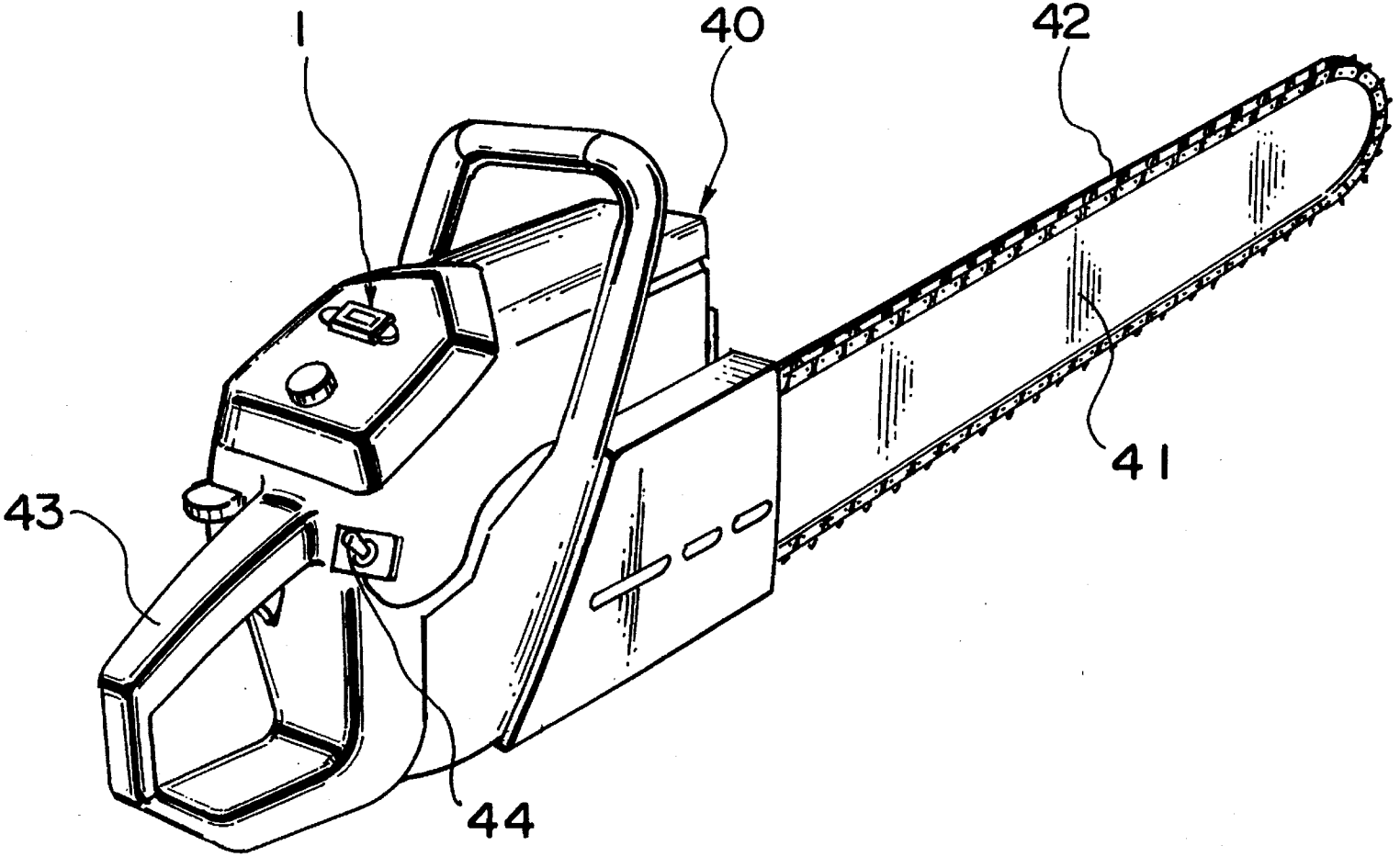
FIG. 4 is an outside view showing a chain saw attached with a time totaling meter for internal combustion engines according to the present invention.

Furthermore, the remaining part of the ignition device as mentioned above is placed inside a chain saw 40 together with said internal combustion engine and said time totaling meter 1 is provided on the chain saw 40 in a manner as freely attachable and detachable as shown in FIG. 4, for example.

This chain saw 40 is provided with a saw chain 42 which can be rotated around a saw chain guide plate 41 by driving force of said internal combustion engine. On the other hand, the case 12 of said time totaling meter 1 is attached on the chain saw 40 near to a handle 43 by attaching screws 13 through screw holes 14 in a manner so as to be attachable and detachable. 44 is a halt switch which is provided on the chain saw 40 near to the handle 43 and used to bring to halt operation of the ignition circuit when it is turned on.

Next, the operation of the time totaling meter and the unit of the same according to the present invention will be explained. When the internal combustion engine is fired and the rotor 21 starts rotating, a magneto coil 22 generates induced voltage by magnetic flux of magnet provided on the rotor 21. Then, said charge/discharge capacitor 27 for ignition is charged by this voltage supplied via said diode 10 consisting of a part of the ignition device.

When the terminal voltage of said resistor 26 reaches the pre-determined voltage, said thyrister 30 is turned on to supply the voltage of the charge/discharge capacitor 27 to the primary coil 28 a of the ignition coil 28. Therefore, high voltage is induced at the secondary coil, and the ignition plug generates spark to fire a mixed gas containing fuel and air so that the internal combustion engine is continuously operated.

On the other hand, in the operation of such internal combustion engines, induced voltage of several hundreds volts is introduced into the charge/discharge capacitor 27 as well as into a part of the circuit; that is, into the time totaling meter 1 having the diode 10 as a part of the ignition device 3.

Therefore, ignition pulses are detected by said pulse induction means 4 during its passing through the diode 10 and then waveform thereof is shaped by the waveform shaping means 5. Output of this shaped waveform is input into the judging means 6. This judging means 6 determines whether output signals from the waveform shaping means are obtained every unit time or not; that is, whether said ignition pulses are those generated by operation of the internal combustion engine or not.

When said ignition pulses were determined that they were generated by operation of the internal combustion engine, the count memory means 7 count and store total operation time from the initial operation of the internal combustion engine (from the first operation of a working machine) based on the result thereof. Then, total counts obtained is displayed by the display means. Voltage induced by the magneto coil was used in this embodiment, voltage generated by the secondary coil 28*b* of the ignition coil, which has larger electromagnetic induction effect, may be used.

On the other hand, to bring the internal combustion engine to a halt, said halt switch 44 is turned on. Thereby the magneto coil 22 is shortened, and charging of the charge/discharge capacitor 27 as well as supply of ignition pulses to said diode 10 are brought to a halt.

Consequently, the operation of the internal combustion engine is brought to a halt and total operation time of the internal combustion engine from start of operation is stored in the count memory means 7. This total operation time can be displayed always or as necessary.

Meantime, when total operation time displayed on the display means 8 of the time totaling meter 1 exceeded 200 hours, the user can perform maintenance to check loosening of bolts and nuts, power down due to time lag of ignition, increase of exhaust gas and the like. Thus, safety and efficient operation of internal combustion engines and working machines can be realized afterward.

Furthermore, said time totaling meter 1 can be removed from working machines such as the chain saw 40 as shown in FIG. 4 to prevent theft and to avoid mischief by children.

Thus, at the same time when the time totaling meter is removed from the working machine, the diode 10 is also removed from the remaining part 2 of the ignition device. Therefore, charging of the charge/discharge capacitor 27 by induced voltage is inhibited so that the internal combustion engine can not be operated. At the same time, the time totaling meter 1 is also brought to a halt.

That is, to operate the internal combustion engine (to use the working machine), the time totaling meter 1 must be attached to the working machine. Specifically, to operate the internal combustion engine, each of the connectors 16 shown in FIG. 3 is connected to corresponding connector 31 so that operation time afterward is accurately and automatically added to the actual total operation time from the initial operation and this total value can be displayed on the display means 8.

In the embodiment described above, the time totaling meter 1 is attached onto an appropriate position of the main body of the chain saw 40 using attaching screw 13 and the like.

Alternatively, another structure in which the time totaling meter 1 is attached or detached by one touch or is screwed in may be used.

In the time totaling meter of the embodiment aforementioned, the diode 10 is mounted on the same printed wiring board 11 on which the pulse induction means 4 and the pulse treatment circuit 9 have been mounted. Thereby, the size and weight of the time totaling meter itself can be minimized. It is needless to say that separate printed wiring boards may be used due to reason of design.

In addition, although the ignition device having the condenser discharge type ignition circuit was shown in FIG. 3, the same can be applied to other types of ignition device having a circuit breaker type ignition circuit using a thyrister and power transistor for switching.

In this circuit breaker type ignition circuit, the primary short-circuit current induced by the ignition coil is introduced to the power transistor and then shortened at the pre-determined timing for example. Thereby, reverse electromotive force is generated at the primary side of the ignition coil and high voltage at the secondary side, then it can be output to the ignition plug.

Figure 5:
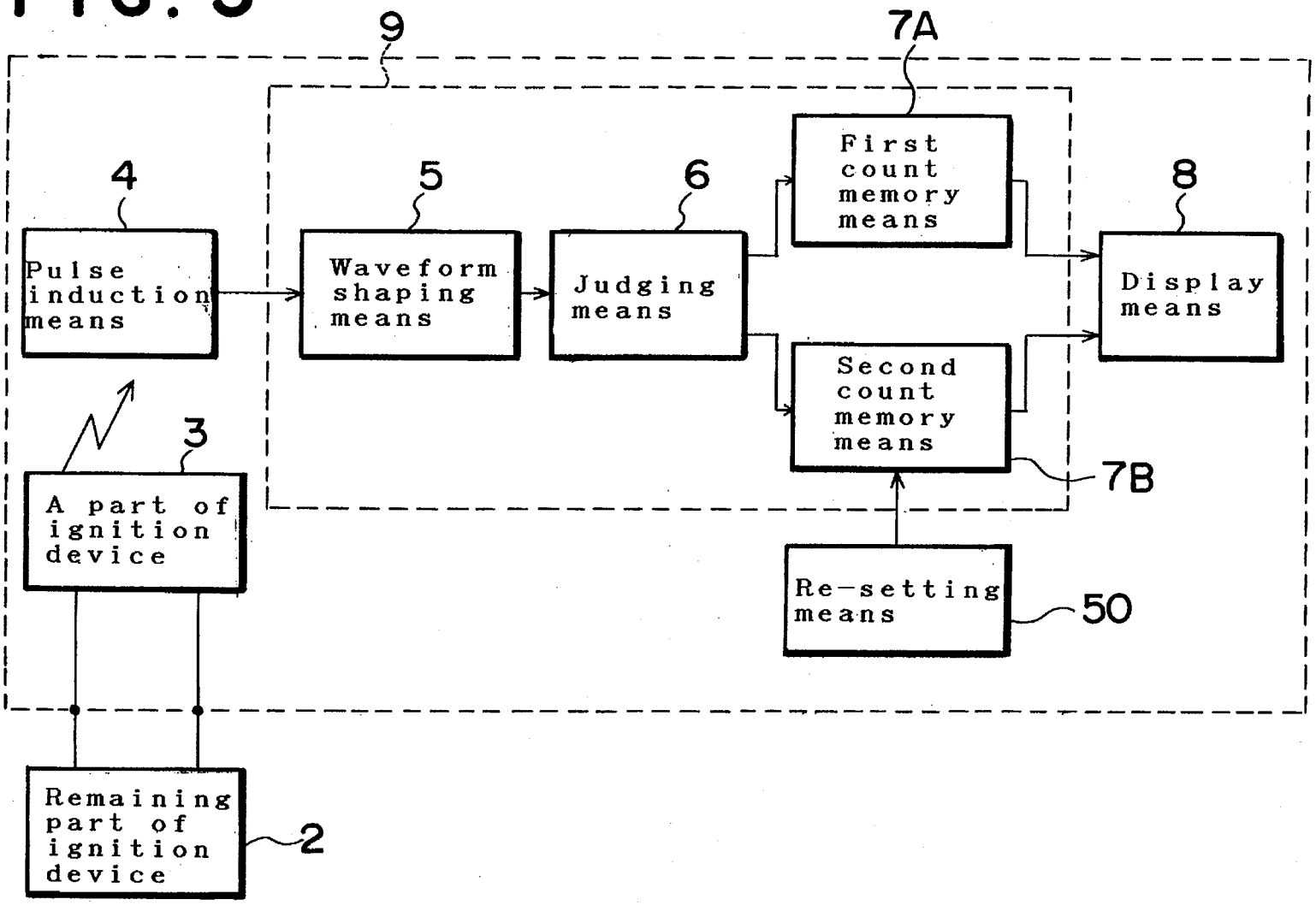
FIG. 5 is a block diagram showing another embodiment of a time totaling meter for internal combustion engines according to the present invention.

FIG. 5 shows another embodiment according to the present invention. Different from the time totaling meter for internal combustion engines aforementioned, in this embodiment, the first count memory means 7A reliably and accurately count and store total operation time from the initial operation. Further, the second count memory means 7B reliably and accurately count and store total operation time from the arbitrary time point set by user by manipulating re-setting means 50. According to this method, each counts and stored value can be displayed by display means 8 by choice. Other operations and effects are the same as those obtained by the previous embodiment.

Figure 6:
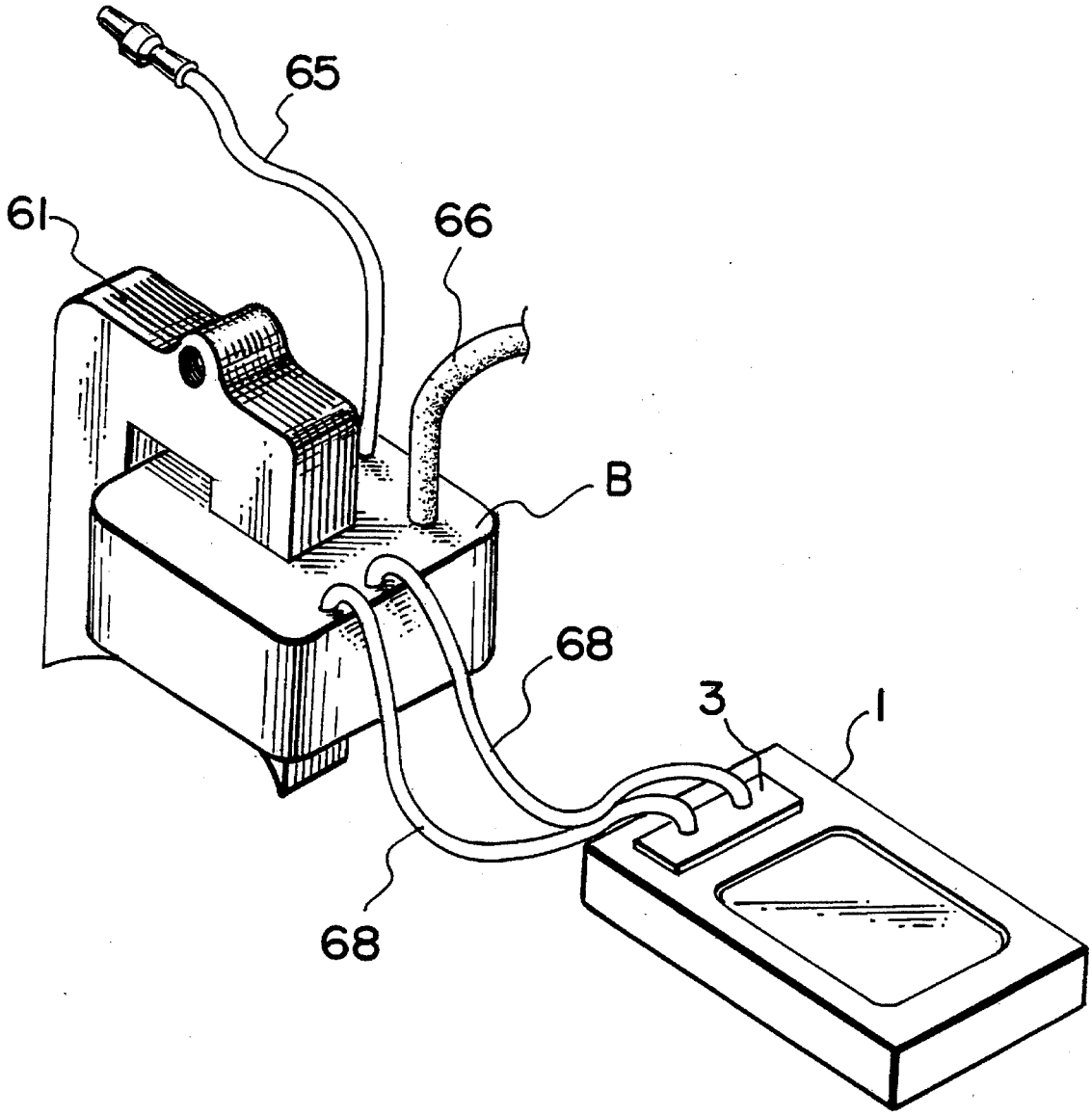
FIG. 6 is a diagram showing connecting structure of a time totaling meter for internal combustion engines according to the present invention.

FIG. 6 shows a connecting diagram of a time totaling meter according to the present invention. This time totaling meter comprises a magneto coil 22, an ignition coil 28 and an ignition device consisted of other ignition circuit are formed as an unit block B by aforementioned one-body molding. In this unit block B, a time totaling meter 1 is also molded in one-body. Wherein, 61 is a magnet core coiled with the magneto coil 22 in the unit block B. 65 is a cable to be connected to a halt switch, and 66 is a high tension cable to be connected to a plug cap.

That is, in this embodiment, the ignition device in the unit block B is connected to a part 3 of the ignition device in the time totaling meter 1 placed on outside the unit block B via cables 68 and 68. Further, in this time totaling meter 1, various cumulative pulse treatment circuits shown in FIG. 1 are provided.

This embodiment is more effective in case one-body molding of the time totaling meter 1 and the ignition device is not appropriate; in case operation and reliability of the time totaling meter are impaired due to effects of heat or noises generated by said ignition device or in case it is necessary to realize highly sensitive integration of sufficient level of ignition pulses directly picked up.

It is not necessary to say that the ignition device may be constructed as condenser discharge type having a trigger coil to generate circuit breaker signals or may be constructed as circuit breaker type having a power transistor to shorten the primary current of an ignition coil by switching a thyrister by output of the trigger coil or by the primary voltage of the ignition coil.

That is, a part or whole of the circuit breaker type or condenser discharge type ignition circuit can be formed in one-body as said unit block B and then attached to said working machine in a manner freely attachable and detachable, combined with the time totaling meter or independently.

FIG. 6 shows the structure of the time totaling unit for internal combustion engines according to the present invention. In this embodiment, the magneto coil 22, the ignition coil 28 and other parts of the ignition device consisted of the ignition circuit are formed as one-body together with the time totaling meter 1 by injection molding of thermoplastic resin or built-in molding of thermoplastic resin so as to form one unit block B.

Figure 7:
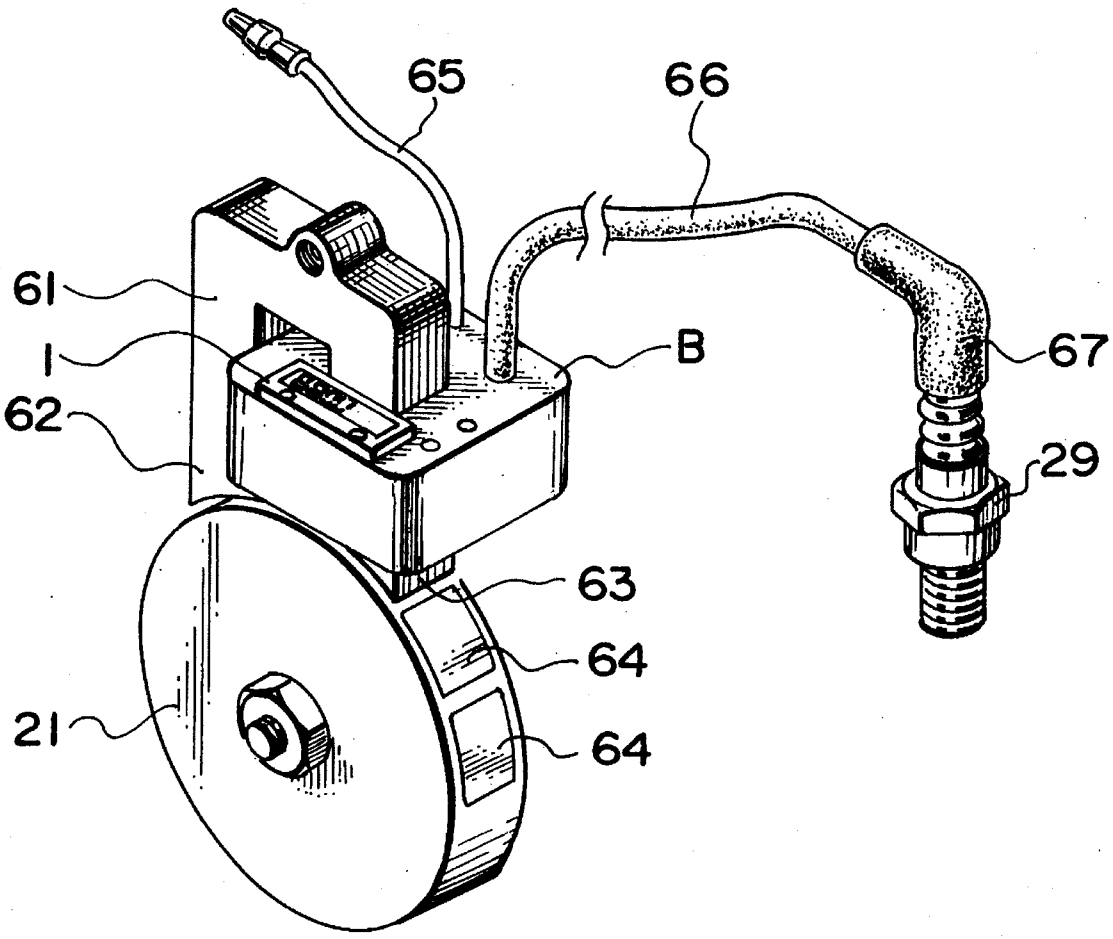
FIG. 7 is an outside view showing a time totaling unit for internal combustion engines according to one embodiment of the present invention.

Therefore, this unit block B is assembled with the magnet core 61 having said magneto coil 22 as shown in FIG. 7. The rotor 21 provided with multiple magnets 64 along its peripheral surface at the pre-determined interval is provided near two magnetic poles 62 and 63 of this magnet core 61 so as to freely rotate. This rotor 21 synchronously rotates by driving force from a driving shaft of the internal combustion engine. Thereby, voltage of pulse form is induced at said magneto coil 22.

65 is the halt switch cable extending from said unit block B and to be connected to said halt switch 44. 66 is the high tension cable connected to the secondary site of the ignition coil 28 in said unit block B and the plug cap thereof is connected to the ignition plug 29 of the internal combustion engine.

In the time totaling unit constructed in this way, the time totaling meter and the ignition device of the internal combustion engine can be formed in one-body and these can be handled as one unit block. Further, a whole ignition control system of the internal combustion engine can be formed in compact size and its operational reliability can be improved.

Figure 8:
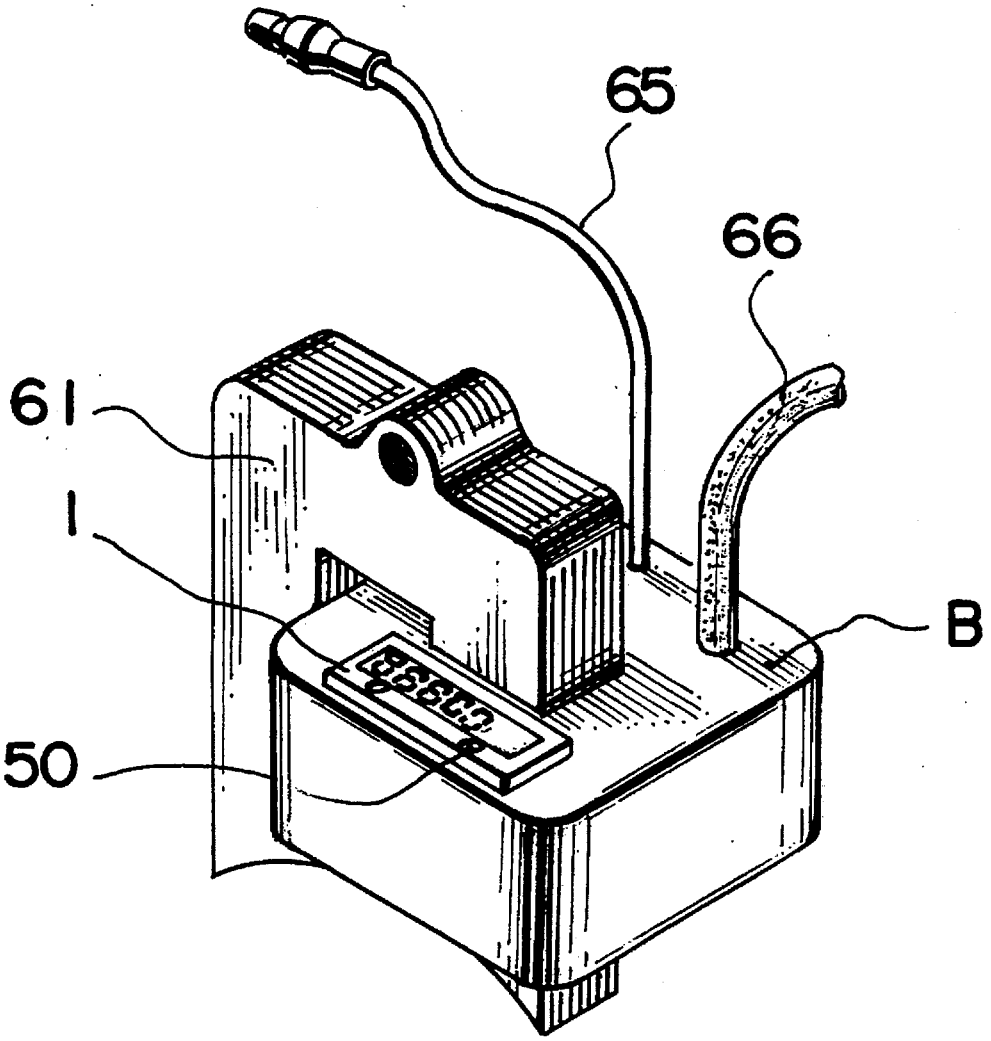
FIG. 8 is an outside view showing a time totaling unit for internal combustion engines according to another embodiment of the present invention.

FIG. 8 shows another time totaling unit according to the present invention. In this structure, the time totaling meter 1 having the first count memory means 7A and the second count memory means 7B shown in FIG. 5 is formed in one-body as one unit block B together with the ignition device.

Further in FIG. 8, the re-setting means 50 as the re-set switch shown in FIG. 5 is provided on the time totaling meter 1. This re-setting means 50 is connected to said second count memory means 7B via the circuit molded in said unit block B.

By manipulating this re-setting means 50, data of total operation time stored in each of the first count memory means 7A and the second count memory means 7B can be displayed selectively on the display means 8.

Therefore, according to this embodiment, the time totaling meter and the ignition device can be molded in one-body together with the re-setting means to bring ignition operation by this ignition device to a halt so that the ignition system having the function to halt the ignition control can be realized by one unit block and a whole system of said ignition circuit can be formed in smaller size and its operational reliability can be improved.

Figure 9:
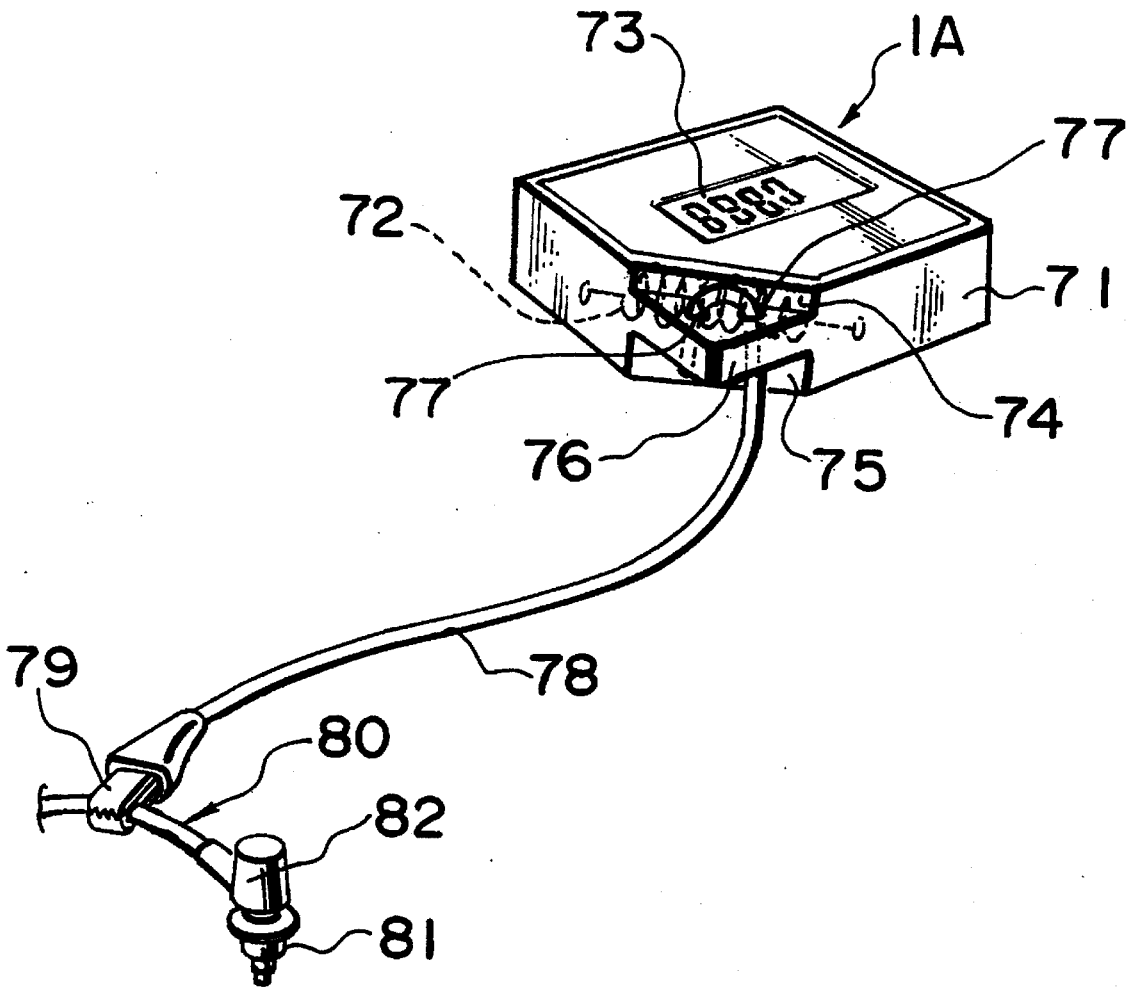
FIG. 9 is an outside view showing another connecting example of a time totaling meter according to the present invention.

FIG. 9 shows another embodiment of the time totaling meter. This time totaling meter 1A comprises the induction coil 72 provided in the case 71 formed from synthesized resin in approximately square shape, wherein the induction coil 72 induces electromagnetic wave generated from the ignition device.

Further in this case 71, the waveform shaping circuit (not shown in the drawing) to shape output waveform of the induction coil 72, the count memory means to count pulses after waveform shaping, and the display means to display the result of counting and corresponding revolution number of the engine are provided.

Further, 73 is the display window of the display means provided on the case 71, and 74 and 75 are notched parts formed the upper and lower surface of the case 71 at one corner thereof near to said induction coil 72 so as to form a notch 7*b* having the pre-determined thickness.

In said notch 76, multiple holes 77 (only two in FIG. 9) are formed in parallel. The antenna lead 78 is inserted into each hole 77 so as to bend one end thereof. 79 is a splicer such as crocodile clip connected to another end of this antenna lead 78. 80 is the high tension cable (ignition cap cable) connected to the ignition plug 81 via a plug cap 82, and said splicer 79 is holding this high tension cable 80 by catching thereof.

In such time totaling meter, the antenna lead 78 attached with the splicer 79 can be firmly connected to the notch 76, by inserting the end thereof into two holes 77 provided on the notch 76 so as to have the angle of 45° against the side face of the case 71.

By connecting the splicer 79 to the high tension cable 80, electromagnetic wave can be obtained by the antenna lead 78 via the high tension cable 80 and then detected by the induction coil 72. Therefore, after treatment of this detected output by each circuit in the case 71, the revolution number of the engine can be detected at highly sensitive level and can be displayed on the display window 73.

Further in this time totaling meter, the end of the antenna lead 78 inserted into said holes 77 is within the level of the notched parts 74 and 75 and housed within the level of total thickness of the case 71. Thus, wiring of the antenna lead 78 is easier.

Furthermore, because any convex parts are not formed to attach the antenna lead 78, occupied space by the case 71 can be minimized so that not only the size of outer and inner package boxes can be reduced and the cost for package can be reduced, also the time totaling meter can be attached on narrower space nearby the internal combustion engine.

Figure 10:
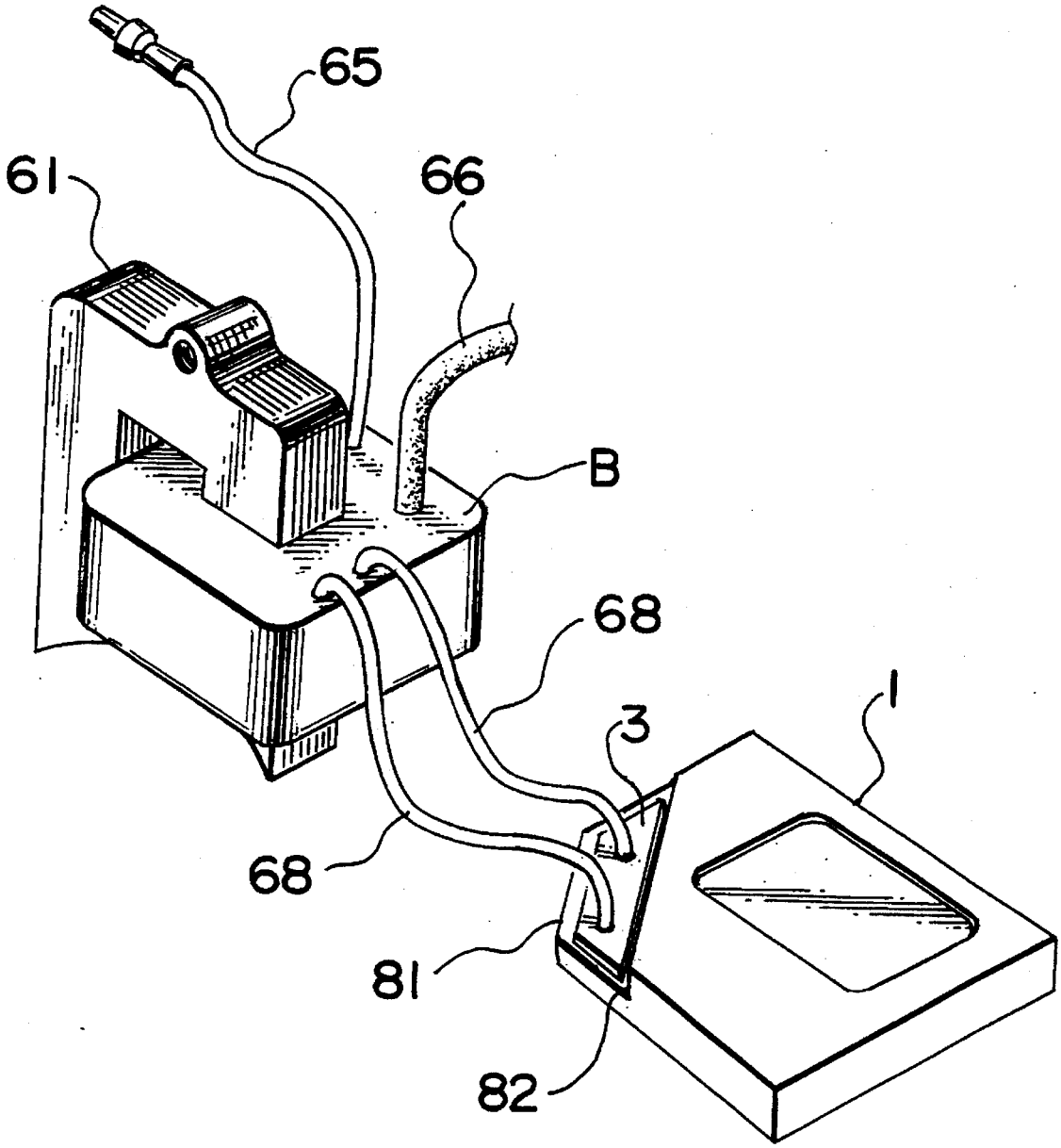
FIG. 10 is an outside view showing another connecting example of a time totaling meter according to the present invention.

Further, even in case the separately prepared time totaling meter 1 is connected to the unit block B via the cables 68 as shown in FIG. 6, it is desirable to form the time totaling meter 1 as shown in FIG. 10.

That is, the notched part 82 is formed on one corner of the time totaling meter 1 to form a trapezoid notch 81 having the pre-determined thickness.

Then, said part 3 of the ignition device is provided on said notch 81 and each of the cables 68 is connected to this part 3. Thereby, the end of each cable 68 on said notch 81 can be housed within the level of said notched part 82 of the time totaling meter 1 so that wiring of each cable is easier.

In addition, because there is no convex formed on the main body of the time totaling meter 1 for attachment of each cable 68, occupied space by this time totaling meter 1 can be minimized, the size and preparation cost of the package can be reduced, and the time totaling meter can be easily attached on narrower space.

What is claimed is:

1. A time totaling meter for internal combustion engines, capable of being attachable and detachable to a working machine with an ignition device having an ignition circuit wherein induced voltage generated synchronously with rotation of said internal combustion engine of the working machine is charged to a charge/discharge capacitor for ignition, discharged current from this charge/discharge capacitor is output at the pre-determined timing to an ignition plug via an ignition coil or a high voltage is output to the ignition plug via the ignition coil by allowing the primary short-circuit current induced by the ignition coil to flow to a transistor and then by shortening that primary short-circuit current at the pre-determined timing, capable of detecting ignition pulses generated by said ignition device and capable of counting total operation time of said internal engine, characterized in comprising a part of the ignition device to pass said ignition pulses toward outside said ignition device, pulse induction means to electromagnetically induce ignition pulses flowing in said part of the ignition device, waveform shaping means to shape the waveform of pulses electromagnetically induced by said pulse induction means, judging means to determine whether the output pulses from said waveform shaping means are of operation of said internal combustion engine or not, count memory means to count and store total operation time of said internal combustion engine from the initial operation thereof based on said output pulses selected by said judging means, and display means to display total operation time of the internal combustion engine counted by said count memory means.

2. A time totaling meter for internal combustion engines described in claim 1, characterized in that a part of the ignition device is mounted on a printed wiring board provided with the pulse induction means and a pulse treatment circuit to treat induced pulses by said pules induction means.

3. A time totaling meter for internal combustion engines described in claim 1, characterized in that a circuit in the ignition circuit of the ignition device for introducing voltage to the charge/discharge capacitor for ignition is connected at the midway thereof with a part of the ignition device via a freely attachable and detachable connector.

4. A time totaling meter for internal combustion engines described in claim 1, capable of implementing integration processing of total time of operation based on ignition pulses obtained via cables connected between said ignition device and said time totaling meter.

5. A time totaling meter for internal combustion engines described in claim 4, characterized in that a notch having a pre-determined thickness is provided on at least one corner of said meter and cables are connected to a part of the ignition device provided in this notch.

6. A time totaling meter for internal combustion engines, capable of being attachable and detachable to a working machine with an ignition device having an ignition circuit wherein induced voltage generated synchronously with rotation of said internal combustion engine of the working machine is charged to a charge/discharge capacitor for ignition, discharged current from this charge/discharge capacitor is output at the pre-determined timing to an ignition plug via an ignition coil or a high voltage is output to the ignition plug via the ignition coil by allowing the primary short-circuit current induced by the ignition coil to flow to a transistor and then by shortening that primary short-circuit current at the pre-determined timing, capable of detecting ignition pulses generated by said ignition device and capable of counting total operation time of said internal engine, characterized in comprising a part of the ignition device to pass said ignition pulses toward outside said ignition device, pulse induction means to electromagnetically induce ignition pulses flowing in said part of the ignition device, waveform shaping means to shape the waveform of pulses electromagnetically induced by said pulse induction means, judging means to determine whether the output pulses from said waveform shaping means are of operation of said internal combustion engine or not, first count memory means to count and store total operation time of said internal combustion engine from the initial operation thereof based on said output pulses selected by said judging means, second count memory means to count and store total operation time of the internal combustion engine from a time point arbitrarily set by re-set manipulation based on said output pulses selected by said judging means and display means to display total operation time of the internal combustion engine counted by said first and second count memory means.

7. A time totaling meter for internal combustion engines, characterized in that the time totaling meter comprises pulse induction means to electromagnetically induce ignition pulses generated by an ignition device synchronously with rotation of the internal combustion engine, waveform shaping means to shape pulses electromagnetically induced by the pulse induction means, judging means to determine at every time unit whether output signals are obtained from said waveform shaping means during that time interval or not, count memory means to count and store the frequency of the output signals obtained from said waveform shaping means after determined by the judging means, and display means to display the time values counted and stored by said count memory means, said meter formed in one-body together with said ignition device for internal combustion engine by injection molding or built-in molding of synthesized resin.

8. A time totaling meter for internal combustion engines, characterized in that the time totaling meter comprises pulse induction means to electromagnetically induce ignition pulses generated by an ignition device synchronously with rotation of the internal combustion engine, waveform shaping means to shape pulses electromagnetically induced by the pulse induction means, judging means to determine at every time unit whether output signals are obtained from said waveform shaping means during that time interval or not, first and second count memory means to count and store the frequency of the output signals obtained from said waveform shaping means after determined by the judging means, re-setting means to re-set counts and stored memory in said second memory means, by user's manipulation, and display means to display the time values counted and stored by said count memory means, said meter formed in one-body together with said ignition device for internal combustion engine by injection molding or built-in molding of synthesized resin.

9. A time totaling meter comprising an antenna lead to induce electromagnetic wave via a high tension cable of an ignition circuit, an induction coil provided at the end of said antenna lead, a waveform shaping circuit to shape the output waveform from said induction coil, count memory means to count, and store output pulses shaped by said waveform shaping means, display means to display a count output by said count memory means, a case to house said induction coil as well as said waveform shaping means, count memory means and display means, a notch formed on at least one corner of said case and having a predetermined thickness, and multiple holes formed on said notch so as to penetrate said notch and to be inserted through with the end of said antenna lead by bending thereof.

* * * * *